US005548861A

United States Patent [19]

Hukuba

[11] Patent Number: 5,548,861

[45] Date of Patent: Aug. 27, 1996

[54] ADHERING CLEANING TOOL

[76] Inventor: Hiroshi Hukuba, No. 914-1, Nazukari, Nagareyama, Chiba, Japan

[21] Appl. No.: 201,328

[22] Filed: Feb. 24, 1994

[30] Foreign Application Priority Data

| | | | |
|---|---|---|---|
| Feb. 25, 1993 | [JP] | Japan | 5-059299 |
| Mar. 19, 1993 | [JP] | Japan | 5-085377 |
| Jul. 7, 1993 | [JP] | Japan | 5-192848 |
| Sep. 9, 1993 | [JP] | Japan | 5-247317 |
| Sep. 24, 1993 | [JP] | Japan | 5-261524 |

[51] Int. Cl.[6] ..... A47L 25/00

[52] U.S. Cl. ..... 15/104.002; 428/906

[58] Field of Search ..... 15/104.002, 230.11; 428/42, 202, 906

[56] References Cited

U.S. PATENT DOCUMENTS

| | | | |
|---|---|---|---|
| 2,811,733 | 11/1957 | Sloan | 15/230.11 |
| 2,873,462 | 2/1959 | Green | 15/230.11 |
| 3,148,398 | 9/1964 | Thomas, Jr. | 15/230.11 |
| 3,176,892 | 4/1965 | Waltz | 15/230.11 |
| 3,225,373 | 12/1965 | Kisbany | 15/104.002 |
| 3,363,276 | 1/1968 | Thomas, Jr. | 15/104.002 |
| 3,417,418 | 12/1968 | Riboud | 15/104.002 |
| 3,537,578 | 11/1970 | Figliuzzi | 428/906 |
| 4,361,923 | 12/1982 | McKay | 15/104 |
| 4,399,579 | 8/1983 | McKay | 15/104 |
| 4,727,616 | 3/1988 | Kucera et al. | 15/104 |
| 4,905,337 | 3/1990 | McKay | 15/104.002 |
| 5,027,465 | 7/1991 | McKay | 15/104.002 |
| 5,066,529 | 11/1991 | Huber | 428/906 |
| 5,366,775 | 11/1994 | Kao | 428/906 |

FOREIGN PATENT DOCUMENTS

| | | | |
|---|---|---|---|
| 0158600 | 4/1954 | Australia | 15/104.002 |
| 0171869 | 2/1986 | European Pat. Off. . | |
| 52-77566 | 6/1977 | Japan . | |
| 54-36556 | 3/1979 | Japan . | |
| 55-2409 | 1/1980 | Japan . | |
| 56-70896 | 6/1981 | Japan . | |
| 57-118060 | 7/1982 | Japan . | |
| 59-136766 | 9/1984 | Japan . | |
| 61-177578 | 11/1986 | Japan . | |
| 62-50555 | 3/1987 | Japan . | |
| 3-73554 | 7/1991 | Japan . | |
| 3-82353 | 8/1991 | Japan . | |
| 2233884 | 1/1991 | United Kingdom . | |

*Primary Examiner*—David Scherbel
*Assistant Examiner*—Randall E. Chin
*Attorney, Agent, or Firm*—Fish & Richardson PC

[57] ABSTRACT

A cleaning tool which uses a disposable adhesive sheet, where the adhesive sheet which is the surface layer of an adhering roller may be peeled and torn in a simple and easy manner without causing the user annoyance or discomfort. The cleaning tool has an adhering roller with an adhesive sheet wound in layers thereon and supported rotatably about an axis. The adhesive sheet forming the surface layer of the adhering roller is peelable from the portion of the adhesive sheet forming the layer thereunder and torn at least in the direction of the width thereof. A stopper means for stopping rotation of the adhering roller is provided.

11 Claims, 11 Drawing Sheets

ADHERING CLEANING TOOL

BACKGROUND OF THE INVENTION

1. Field of the Invention

The present invention relates to cleaning tools and, more particularly, to a cleaning tool in which an adhering roller having tackiness on the surface thereof is rolled along the surface of an object to be cleaned so that it is cleaned by causing rubbish and the like to adhere thereto.

2. Description of the Related Art

In a widely used type of cleaning tools: a roller having tackiness is rotatably supported about an axis; the roller is brought into contact with the surface of an object such as a carpet or tatami which is to be cleaned; and the tool is moved to roll the roller to thereby cause dust, hair, waste thread, etc., (hereinafter: referred to as "rubbish and the like") to adhere to the adhesive layer on the roller surface. This type of cleaning tool is advantageous in that, unlike the so-called electric cleaner, it makes no noise and does not stir up dust. Among this type of cleaning tools are a sheet roll type comprising a roll of adhering sheet and another type in which an adhering layer on the roller surface may be repeatedly used by washing it by means of a washing liquid such as water.

In the above roll sheet type, an adhering roller having thereon an adhesive sheet wound in layers is supported rotatably about an axis. The adhesive sheet of the surface layer of the adhering roller is formed as capable of being peeled from the adhesive sheet of the layer thereunder and may be torn along the direction of the width thereof by means of hands. Accordingly, when rubbish and the like adheres to the surface of the adhering roller to lower the adhering capability of the surface thereof, the adhesive sheet forming the surface of the adhering roller is peeled and removed therefrom. A new surface layer of the adhesive sheet is thereby provided so that cleaning may be repeated.

In the conventional example, considering the convenience in peeling and tearing the surface layer of the adhering roller, machine stitches for facilitating detachment along the direction of the width thereof are provided or cuts are made on both sides widthwise thereof at about every 360° of the continuous adhesive sheet. Also, a cutter piece or sawteeth extended widthwise is provided closely to the surface of the adhering roller, so that it is used to pull apart the adhesive sheet of the surface layer (see, for example, Japanese Utility Model Laid-Open Nos. 57-118060 and 62-50555). In actually performing peeling and tearing, however, the user is required first to hold the roller by his hands so as to prevent a rotation of the roller. While holding the roller, the user must pinch by means of his nails or the like the very terminal end of the surface layer which is to be peeled, and peel it through 360°, and then tear it off. In doing so, the sheet may be broken in the midway of peeling the very terminal end thereof as the very terminal end of the surface layer to be peeled is not well peeled. Furthermore, it was difficult to tear the sheet to be peeled securely along the direction of the width of the rear end thereof. Consequently, the user is required not only to stabilize the adhering roller but also to tightly hold by means of his hand, etc., the surface with the rubbish and the like adhered thereto of the roller along the direction of the width thereof. Such operation is very difficult to do and gives discomfort to the user.

SUMMARY OF THE INVENTION

In view of the problems of the conventional art, it is an object of the present invention to provide a cleaning tool of the sheet roll type, in which the adhesive sheet of the surface layer of the adhering roller may be peeled and torn therefrom in a very convenient and easy manner so that the user is able to perform such operation without being annoyed or feeling discomfort.

The inventor of the present invention, as a result of an intense research for achieving such object, has noticed that the reasons for making it difficult to smoothly perform peeling and tearing operation in the conventional art are in the fact that, since the adhering roller is rotatable, the adhering roller must be stopped by means of hands to prevent its rotation at least at the time of peeling even if sawteeth or the like is provided and that the adhering roller is not sufficiently stabilized as the user hesitates to hold by his hand the roller surface to which the rubbish and the like adheres. Based on this, according to the present invention, in a cleaning tool where: an adhering roller having an adhesive sheet wound in layers thereon is supported rotatably about an axis; and the adhesive sheet of a surface layer of the adhering roller is formed as peelable from the adhesive sheet of the layer thereunder and torn at least along the direction of the width thereof—stopper means for preventing a rotation of the adhering roller is provided.

In the above construction, it is also possible to provide means for tearing the adhesive sheet along the direction of the width thereof.

Further, it is also possible to form both the stopper means and the tearing means as a pressing member which is provided in a manner capable of being brought into contact with and moved away from the surface of the adhering roller.

By simply providing stopper means for preventing the rotation of the adhering roller on the cleaning tool, it is possible, without directly using the user's hands, to perform the stopping operation of the adhering roller which has been relatively annoying and difficult. The induced rotation of the adhering roller at the time of peeling of the adhesive sheet may thus be prevented whereby such peeling operation may be performed easily. Moreover, by additionally providing the tearing means, the tearing operation of the adhesive sheet is furthermore facilitated.

Furthermore, the tearing means may be inclined, whereby the end edge of the adhesive sheet which has been torn by means of the tearing means may be inclined toward the winding direction from the starting end of the peeling to the opposite side end thereof, i.e., toward the direction along which the adhesive sheet is peeled with respect to the peripheral direction thereof. The adhesive sheet having such end edge form significantly facilitates such peeling operation when compared with one having its end edge form straight in the direction of the width thereof. In particular, when peeling the end edge of the adhesive sheet, while the starting end of the peeling is pinched by fingers so as to exert force to peel the end edge of the adhesive sheet not only in the direction of the width but also in the winding direction, the component force in the winding direction of the force thereof may cause a lengthwise tear of the adhesive sheet in the course thereof. Here, since, according to the present invention, the end edge formed is inclined toward the winding direction, the above described component force in the winding direction contributes to peeling in the direction of the width of the end edge, making possible a smooth peeling operation without breaking the adhesive sheet.

By forming the pressing member as one serving both in the rotation preventing operation and as the tearing means, complicated construction may be avoided.

DESCRIPTION OF THE PREFERRED EMBODIMENTS

Figure 1:
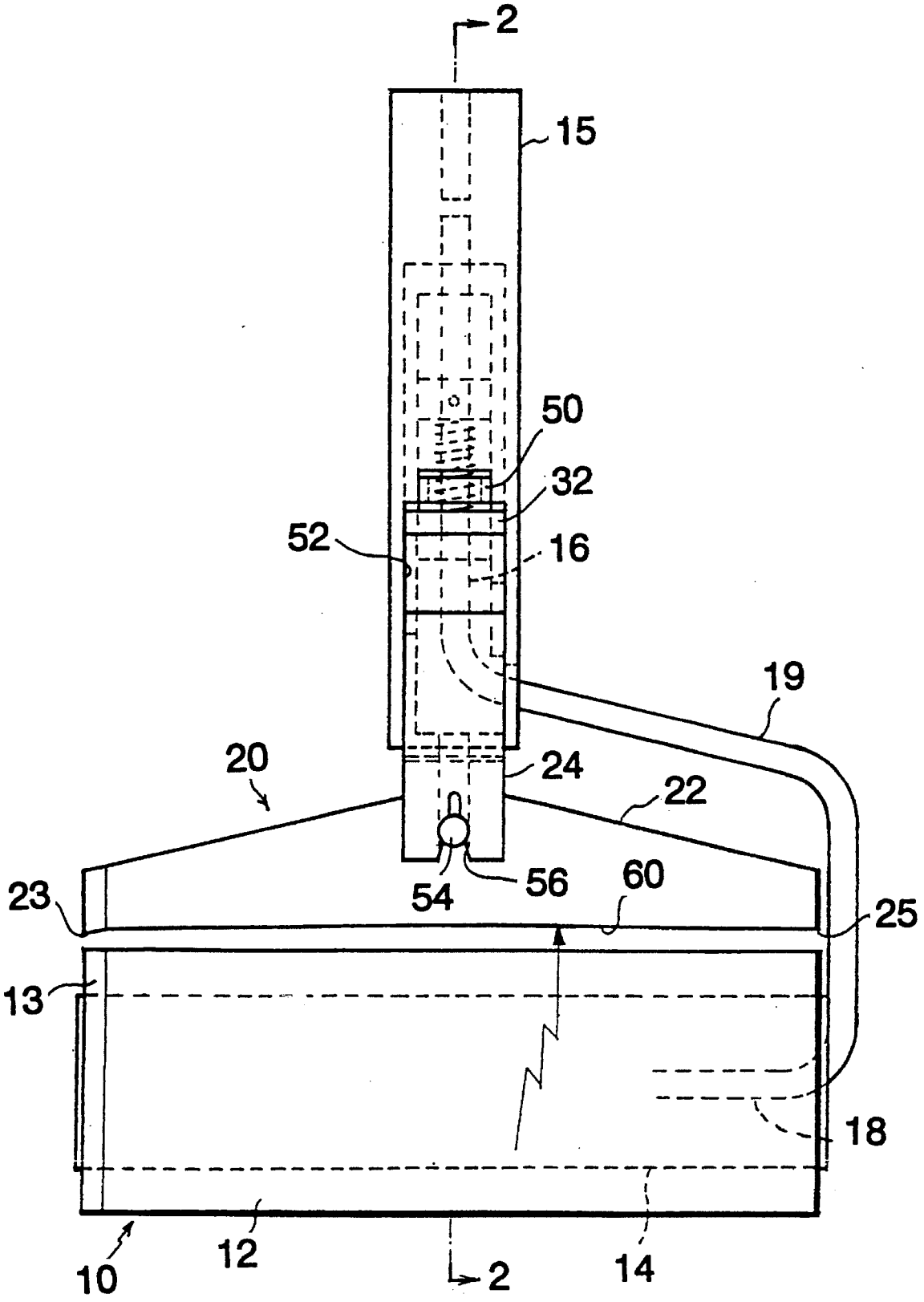
FIG. 1 is a front view of an embodiment of a cleaning tool according to the present invention.

The present invention will now be described by way of some embodiments as shown in the drawings.

An embodiment of the present invention is shown in FIGS. 1 to 5. Numeral 10 denotes an adhering roller. The adhering roller 10 is constructed such that an adhesive sheet 12 formed as a series of sheets connected in a band-like manner and having tackiness at least on the obverse surface thereof is wound around a tube 14 in layers. The adhering roller 10 is supported rotatably about an axis 18 by way of the tube 14. One end portion of the axis 18 is extended furthermore upward from the adhering roller 10 in an integrated manner as a supporting axis 16 through a connecting portion 19 which is bent and extended in substantially the shape of a U. While, as described, the axis 18 is supported at one side thereof by means of the supporting axis 16, it may alternatively be supported at both sides thereof. A handle 15 is fixed in an integrated manner to the supporting axis 16 so that cleaning is performed by holding this handle 15 or a shaft 17 is furthermore connected to the apex of the handle to use it with a longer shaft. With this type of cleaning tool, a driving source such as a motor is not required. It suffices to simply bring the adhering roller 10 into contact with an object such as a floor to be cleaned and to move it along. The adhering roller rolls along the surface of the object to be cleaned and adheres the rubbish and the like by means of the adhering layer on the surface thereof to clean it. Here, the adhesive sheet 12 is formed from a material such as bleached kraft paper, which may be easily peeled and pulled apart by means of hands.

What is denoted by numeral 20 is a pressing member. The pressing member 20 is formed in the manner of an inverted T as a whole as seen from its front and is supported by the above described handle 15. The pressing member 20 comprises a pressing portion 22 which is extended horizontally substantially in the same width as the width of the adhering roller 10 and a supporting portion 24 which is extended upward from the center portion of the pressing portion 22 and is supported in a manner slidable within the handle 15.

Figure 2:
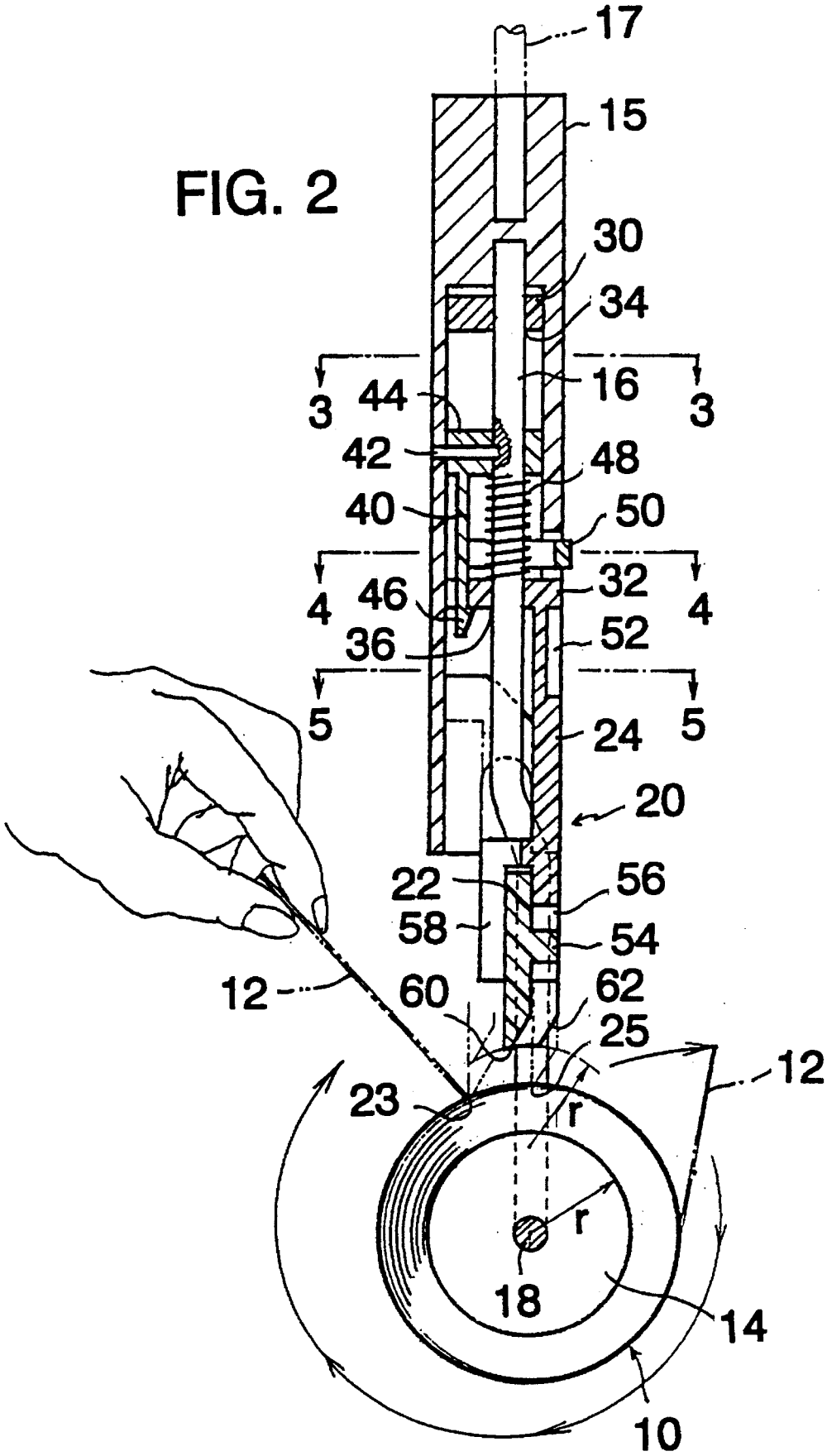
FIG. 2 is a cross section taken along line 2—2 of FIG. 1.

The supporting portion 24 is inserted at the upper portion thereof in a manner slidable into a hollow formed in the handle 15 and is exposed at the lower portion thereof to the front surface of the handle 15 on the same level as the handle. The supporting portion 24 includes in an integrated manner an upper wall 30 on the upper end thereof, a pair of side walls 38, 38 extended downward integrally from the upper wall 30, and a middle wall 32 at the center position thereof, the portion below the middle wall 32 being exposed as described. The above described supporting axis 16 is inserted in a manner slidable through holes 34, 36 which are formed on the upper wall and the middle wall, respectively. Numeral 40 denotes a holding piece, which is extended downward from a base portion 44 fixed by way of a pin 42 to the handle 15 and the supporting shaft 16. The lower end of the holding piece has a holding projection 46 formed in the manner of a hook in the upward direction. In the state as shown in FIG. 2, the holding projection 46 penetrates through the above described middle wall 32 and holds the middle wall 32 from the lower end thereof. A coil spring 48 is placed between the upper surface of the middle wall 32 and the above described base portion 44 so that the middle wall 32 and, consequently, the pressing member 20 as a whole is urged toward the adhering roller 10 by means of the urging force of the coil spring 48. Numeral 50 denotes a releasing piece extended horizontally integrally from said holding piece 40, the releasing piece 50 being positioned in a manner slightly projected from the surface of the handle 15. Thus, by simply pressing the releasing piece 50, the holding piece 40 is resiliently deformed to release the engagement between the holding projection 46 and the middle wall 32. Further, numeral 52 denotes a recess formed at the lower portion of the supporting portion 24 which is to be exposed. The recess 52 is provided in order to pull the pressing member upward from its roller pressing position to the above described holding position by seizing it by fingers and it is positioned adjoining to the above described releasing piece 50. Thus, the user is able to hold by his hand the upper portion of the handle 15 to bring upward the pressing member 20 by seizing the recess 52 by means of the thumb or the like of the holding hand or to press the pressing member 20 to the roller by pressing the releasing piece 50 in, where such operation is possible by one hand.

The pressing portion 22 of the pressing member 20 has at the upper central portion thereof a pin 54 integrally projecting in the horizontal direction and it is supported pivotally within a certain range at the lower end of the supporting portion 24 by way of the pin 54. In particular, a slit 56 which is broadened toward an end 21 thereof is formed at the lower end of the supporting portion 24 and, by resiliently inserting the pin 54 into the slit 56, the pressing portion 22 is pivotally supported by holding the pin 54 within the slit 56. This pivotable supporting structure of the pressing portion 22 is provided so that the pressing portion 22 accurately presses the adhering roller surface even when the roller axis 18 is bent or when the pressing portion is inclined toward the sheet winding direction as will be described later. It should be noted that numeral 58 denotes a relief formed on the side surface opposite to the above described slit 56 of the supporting portion 24, which is provided so that the supporting axis 16 may be inserted into the handle 15 through the relief 58 at the time of assembling.

Figure 3:
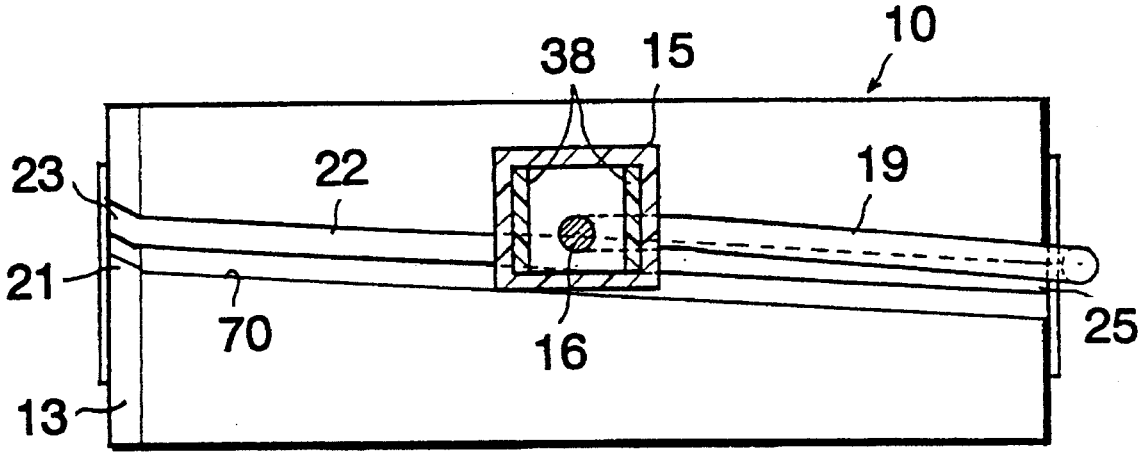
FIG. 3 is a cross section taken along line 3—3 of FIG. 2.
Figure 4:
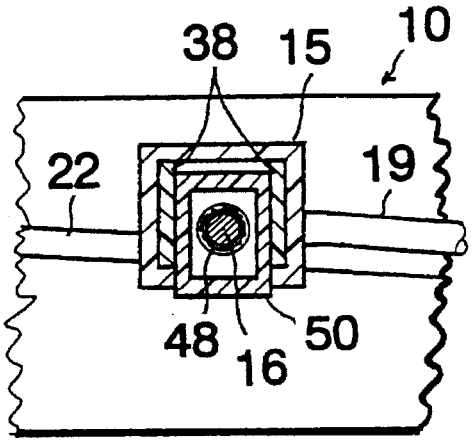
FIG. 4 is a cross section taken along line 4—4 of FIG. 2.
Figure 5:
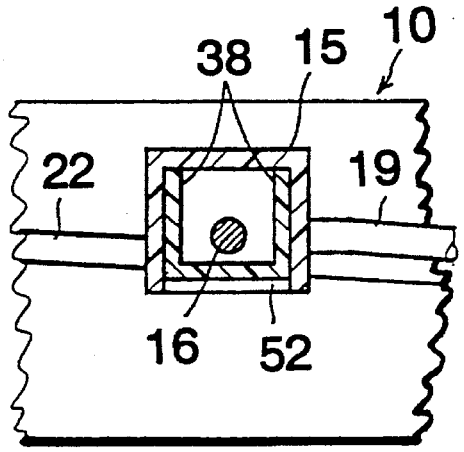
FIG. 5 is a cross section taken along line 5—5 of FIG. 2.

The body of the pressing portion 22 may be formed to be able to press from one end to the other widthwise of the adhering roller and a lower end edge 60 thereof is thinned in thickness due to the existence of the tapered surface 62. Further, as is apparent from FIGS. 2 and 3, the pressing portion 22 is inclined with respect to the axial line of the adhering roller 10. In particular, when peeling the adhesive sheet 12, the user pinches by means of fingers the end (left end as shown in FIG. 3) opposed to the connecting portion 19 for connecting the axis 18 to the supporting axis 16 to first peel the adhesive sheet 12. From a peeling start end 23 to an opposite side end 25 thereof, the pressing portion 22 is angled in the direction in which the sheet is peeled, with respect to the peripheral direction (clockwise in FIG. 2). In the case where the axis 18 is supported for example at both ends thereof, the start end of peeling of the sheet is determined by the user's preference. In this embodiment, thus, the side with the above described tapered surface 62 functions as a peeling operation side of the adhesive sheet 12. On the other hand, the opposite side of the pressing member 22 is extended perpendicularly above the adhering roller surface so as to be suitable in pulling apart the adhesive sheet 12 along this side surface, serving as a tearing operation side. As described, since the pressing portion 22 is inclined toward the winding direction of the sheet as seen from the peeling start end, the adhesive sheet to be pulled apart along this pressing portion is also torn in a manner inclined toward the sheet winding direction as seen from the peeling start end.

Furthermore, in this embodiment, a lower end edge 60 of the pressing portion 22 is formed in a curving manner to have a predetermined radius of curvature so that it is able to press uniformly as possible the adhering roller 10 along the surface widthwise thereof (see FIG. 2). Such radius of curvature r is preferably the radius of curvature which is the same as the minimum effective radius r in the case where only a small amount of the adhesive sheet 12 wound on the adhering roller 10 remains. Furthermore, it has been found that, in tearing the adhesive sheet 12 off along the pressing portion 22, the tearing efficiency is higher when such tearing line delineate a locus which continually rises from the peeling start end (i.e., the tearing start end) as seen from the side surface shown in FIG. 2. Thus, the contacting point of the pressing portion 22 with the adhering roller 10 at the above described opposite side end 25 is set to be on the imaginary line which is extended upward in the vertical direction from the center of axis 18 in FIG. 2. Thereby, the rising tendency is continually kept from the peeling start end 23 to the opposite side end 25. Here, since it is required to expose the supporting portion 24 of the pressing member 20 toward the front surface, the supporting portion 24 is positioned in a manner slightly shifting to right from the supporting axis 16 as shown in FIG. 2. For this reason, the above described connecting portion 19 is preferably curved to be horizontally shifted to right with respect to the supporting axis 16, so as to secure the above described upward tendency of the pressing portion 22.

Furthermore, in this embodiment, the peeling start end 23 of the pressing portion 22 is inclined even more steeply. In particular, the peeling start end 23 of the pressing portion 22 is inclined at an angle of inclination which is larger than the angle of inclination of the body thereof, i.e., inclined more steeply to the direction opposite to the winding direction of the sheet. Also, in this embodiment, the adhesive sheet 12 is adapted not to have tackiness on the surface thereof for a width of several millimeters at the sheet peeling start edge 13. Thereby, an end 70 of the adhesive sheet which remains after detachment along the pressing portion 22 as a result has a projecting piece which will serve as a tab 21 at the sheet peeling start edge. In addition, since such tab is without tackiness, it is inherently separated from the surface of the underlying layer. Thus, the above described tab 21 may be simply pinched by fingers to remove the sheet even without requiring the operation of peeling an end of the sheet.

A description will now be given of the operation of the embodiment having the construction as described above. In the state as shown in FIGS. 1 and 2, the pressing member 20 is separated from the adhering roller 10. In this state, the adhering roller 10 is rotatable about the axis 18 thereof so that it is able to roll over the object such as a floor to be cleaned so as to adhere the rubbish and the like thereon.

In the case where the tackiness has become weak as a result of adhering of the rubbish and the like to the surface of the adhering roller 10, the engagement between the holding projection 46 and the middle wall 32 of the pressing member is released by pushing the releasing piece 50 extended from the holding piece 40 to deform the holding piece. The pressing member 20 is thus automatically lowered by means of the urging force of the coil spring 48. The lower end edge 60 of the pressing member 22 prevents the rotation of the adhering roller 10 as it is pressed against the surface of the adhering roller 10 by the urging force of the coil spring 48. At this time, it is desirable for the peeling operation that the end 70 of the adhesive sheet which constitutes the surface layer of the adhering roller is shifted by a predetermined distance, for example 5 to 10 millimeters, in the winding up direction of the sheet from the lower end edge 60 of the pressing member. Accordingly, the rotation of the adhering roller may be prevented without pressing of the adhering roller 10 directly by the user. In this manner, the peeling operation of the adhesive sheet constituting the surface layer may be performed easier comparing to the conventional example.

In the case where the adhesive sheet has already been torn along the pressing member 20, the sheet end 70 is gradually inclined toward the sheet winding direction as seen widthwise from the peeling start end and the tab 21 without tackiness is formed at the peeling start end thereof. Accordingly, the user pinches the tab 21 and peels the adhesive sheet 12 of the surface layer clockwise of FIG. 2 as indicated by dashed line in FIG. 2. Such operation becomes easy, since the adhering roller 10 is prevented from its rotation by the pressing member 20 and the vicinity of the end 70 of the adhesive sheet to be peeled is pressed by the pressing member 20 in the direction opposite to the peeling force. Furthermore, as described, the end 70 of the adhesive sheet is inclined toward the sheet winding direction widthwise from the peeling start end. In peeling this sheet, therefore, the peeling force applied on the sheet acts in such a manner that the component force lengthwise of the sheet, rather than breaking the sheet in such direction, peels it widthwise.

Unlike the conventional example, breaking of the sheet at starting of peeling of the sheet does not occur and it is possible to smoothly perform such operation.

After the end 70 of the sheet is completely peeled in the direction of the width, continuous peeling of the sheet 12 in the direction of the length clockwise of FIG. 2 results in that the base end of the peeled sheet reaches the lower end edge 60 of the pressing member 20. In this state, the adhesive sheet 12 is torn starting from the peeling start end, i.e., the tearing start end along the lower end edge 60 of the pressing member 20. Here, since the above described lower end edge 60 is formed to have a radius of curvature corresponding to the minimum effective radius of the adhering roller in the direction of the width thereof, it as a result securely presses the surface of the adhering roller at least at both ends widthwise thereof. Thus, the tearing operation, which was annoying and difficult with the conventional device may be smoothly performed. Furthermore, since, in this embodiment, the tear end point is located at the highest position as seen widthwise (see FIG. 2), the tearing performance is further improved through the tear end of the sheet.

In this manner, by removing the sheet of the surface layer to which the rubbish and the like adheres, a new sheet surface with tackiness and without rubbish adhered thereto may be exposed to make possible again performance of cleaning operation. When starting the cleaning operation again, the user merely puts a finger on the recess 52 and to bring it upward against the urging force of the coil spring 48. Thereby, the pressing member middle wall 32, while causing the holding projection 46 of the holding piece to resiliently retract, exceeds the level thereof, and, upon such exceeding, the holding projection is restored to its original shape to engage the lower surface of the middle wall 32. Thereby, the pressing roller 20 may be maintained in its state separated from the adhering roller and the adhering roller 10 is returned to the state where it is rotatable.

In this embodiment, by holding the handle 15, for example, with the left hand and setting the front of FIG. 1 as the direction viewed by the user, the thumb of the left hand may be used to perform by one hand the pressing-in operation of the releasing piece 50 and the pulling-up operation of the pressing member. Thereby, the right hand may be used to peel the adhesive sheet and to tear and remove the adhesive sheet along the pressing member.

Furthermore, in this embodiment, since both the means for preventing the rotation of the adhering roller and the means for tearing the adhesive sheet are achieved by one pressing member, it is possible to perform the necessary work by a very simple operation and without increasing the number of component parts.

Figure 6:
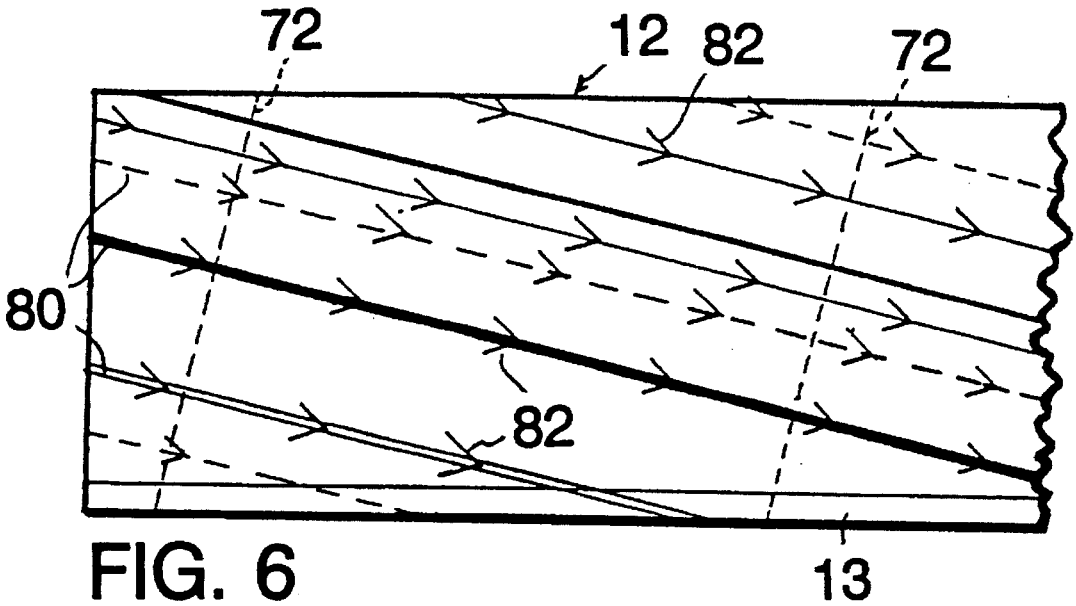
FIG. 6 is a front view of an embodiment of the adhesive sheet of the present invention showing state where the sheet is extended.

The above described stopper means and tearing means of the adhering roller may be formed as different members or may be separately provided. For example, it is also possible to provide cuts 72 as shown in FIG. 6 on the adhesive sheet itself as the tearing means, so as to make easier to tear along the widthwise direction or the line inclined toward the winding direction of the sheet from the peeling start end to the opposite end. Machine stitches or any other means which facilitate the tearing of the sheet may be used as the cuts 72. In this manner, the stopper means of the adhering roller should not be limited to be a pressing member for pressing the surface of the adhering roller from the outside, but may be anything capable of practically locking the rotation of the adhesive roller.

An embodiment for making it easier to find the end 70 of the adhesive sheet which is wound around in the manner of a roll will now be described with reference to FIGS. 6 to 9. In this embodiment, provided as an identification means on the surface of the adhesive sheet 12 is an identification line 80 which is inclined by a predetermined angle with respect to the longitudinal axial line of the sheet and continues lengthwise of the sheet. The identification line 80 can be colored in such a manner that the colors vary in the direction of the adhesive sheet. The identification line 80 is provided in a plural number with respect to the direction of the width and interval pitches between these lines are set differently from each other. Furthermore, in this embodiment, the characteristic of each line, for example, thickness, differs from another. In addition, each line is provided with an arrow 82 which serves as the marking for indicating either the direction along which the sheet is taken or the sheet winding direction. Here, while printing is the most suitable method for providing such identification lines on the sheet surface, it should not be so limited, and stitches, for example, or other means may be used.

Figure 7:
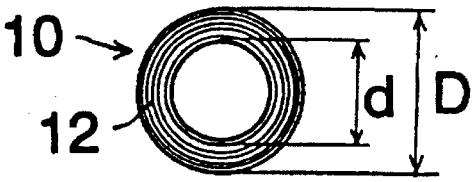
FIG. 7 is a side view of an adhering roller.
Figure 8:
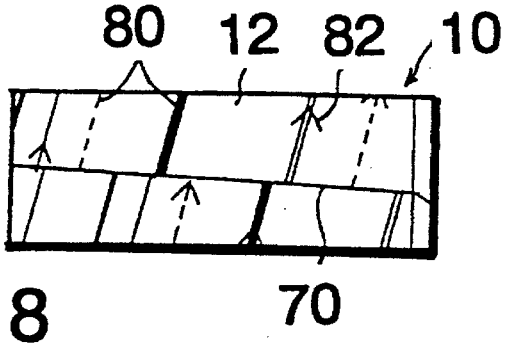
FIG. 8 is a front view of an adhering roller using the sheet of FIG. 6.
Figure 9:
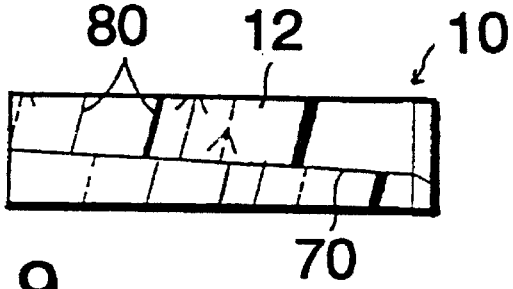
FIG. 9 is a front view showing the adhering roller in the state where its effective radius has become smaller.

In this manner, by providing identification lines 80 for the sheet as shown in FIG. 6, the surface of the adhering roller 10 obtained by winding up the sheet in the manner of a roll has the identification lines which creates a discernible misalignment between the top layer and subsequent layer along the tear line as shown in FIG. 8. Thus the tear end 70 thereof may be easily found by the user. The state shown in FIG. 8 presents the case where the effective diameter in FIG. 7 is D. Even in the case where such effective diameter has become d which is its minimum, the identification lines are necessarily to be misaligned as shown in FIG. 9 at the end 70 of the sheet.

It should be noted that it is not necessary to limit the number of the identification lines widthwise to be plural and it may be one. In such a case, the identification line preferably continues without an interruption from the tear end 70 of the surface layer to the subsequent layer underneath this end 70 through 360° thereof in the state of the adhering roller having its maximum diameter D. Further, it is not necessary to limit the identification means to be consisting of lines. For example, a strap-like form may also be used. It is only required to be one capable of being practically discriminated from other regions and be continuous in a various manner (minor interruption is possible) in the direction of the sheet length. Also, according to the above embodiment, since a mark, an arrow for example, for indicating the taking up direction of the sheet is provided, the user is given an orientation that the sheet is to be peeled along the direction of the arrow. Thus, peeling operation of the sheet is furthermore facilitated.

Figure 10:
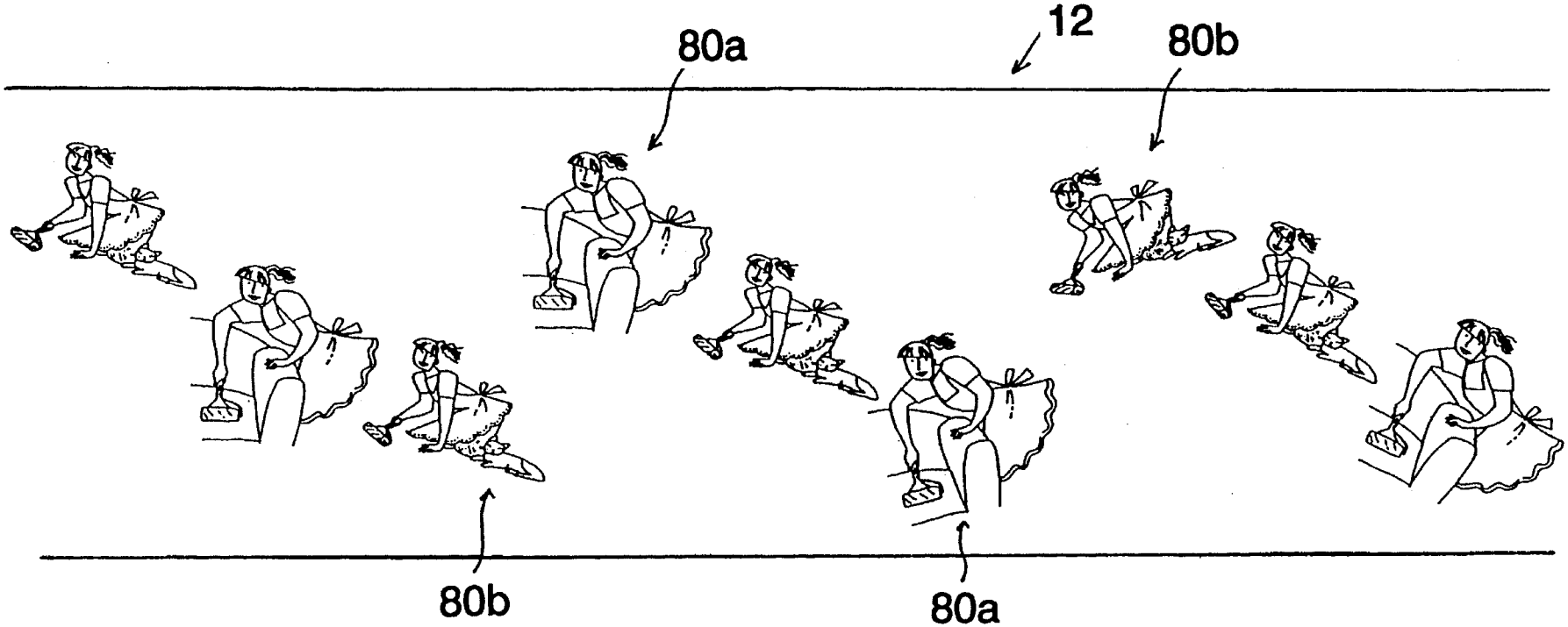
FIG. 10 is an extended front view of the adhesive sheet showing a modification of the identification means.
Figure 11:
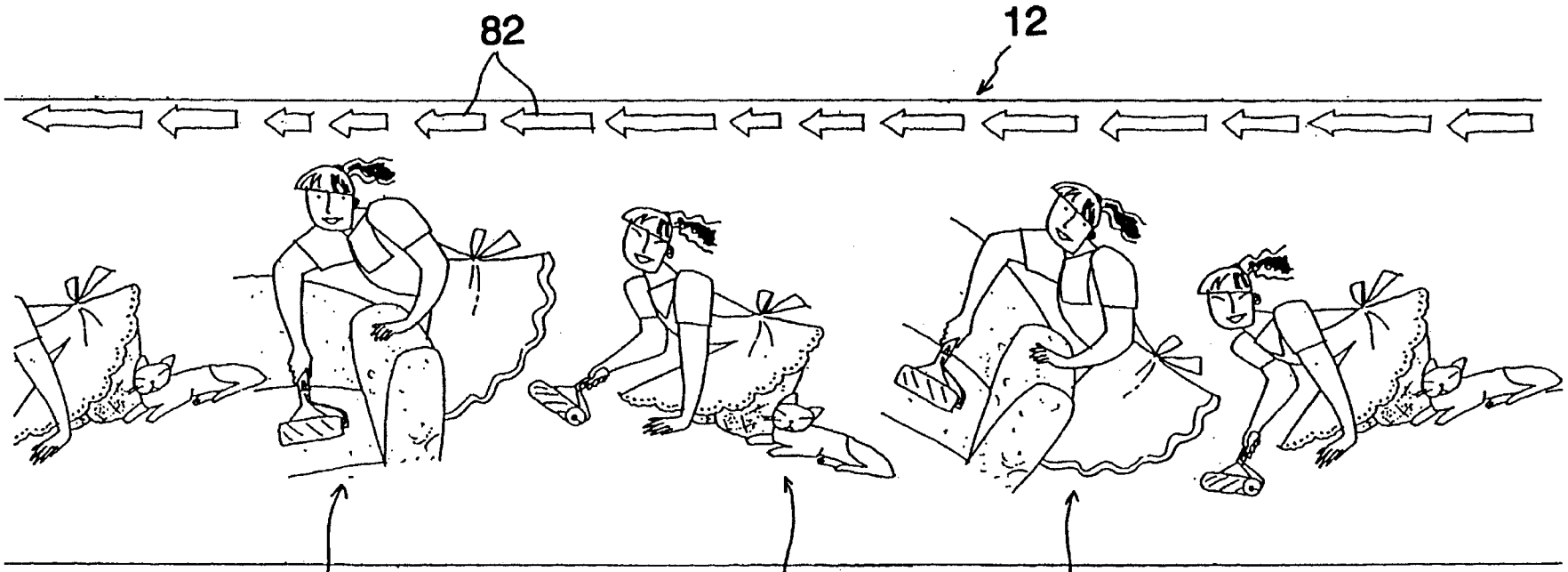
FIG. 11 is an extended front view of the adhesive sheet showing another modification of the identification means.
Figure 12:
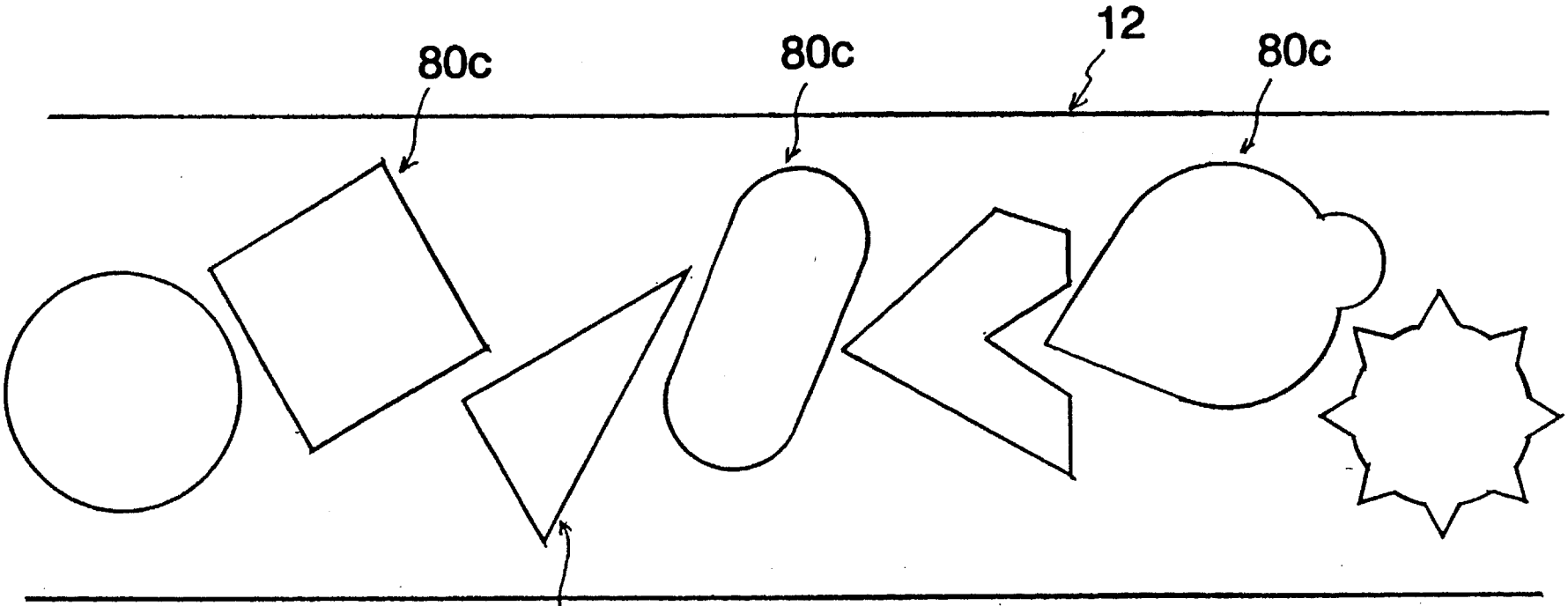
FIG. 12 is an extended front view of the adhesive sheet showing still another modification of the identification means.

Modifications of such identification means, especially those using figurative representation as the identification means are shown in FIGS. 10 to 12. One shown in FIG. 10 uses two kinds of FIGS. **80*a* and 80*b*, three for each figure being positioned in the direction inclined with respect to the longitudinal axial line of the adhesive sheet 12. Further, there is at least a portion of the figures somewhere along any lines perpendicular to the longitudinal axial line. This example is especially suitable in the case where the tearing line of the adhesive sheet is limited substantially to the above described direction of the width. In the one shown in FIG. 11, the two types of figures of FIG. 10 are alternately placed in their enlarged size with no such a position where no figures exists in the direction of the width. Particularly in this example, a plurality of arrows serving as mark indicating the sheet taking up direction are disposed along a side end edge of the sheet and these arrows are regularly different in length from each other. Thereby, an identification function for identifying an edge of the adhesive sheet is also provided. The one shown in FIG. 12 is an example of using a plurality of geometrical FIGS. 80***c* as the identification means. It should be noted that providing of these various identification means on the surface of the adhesive sheet is advantageous in that an end of the adhesive sheet may be easily found even when they are applied to those cleaning tools without the stopper means and/or tearing means such as the above described pressing member.

Figure 13:
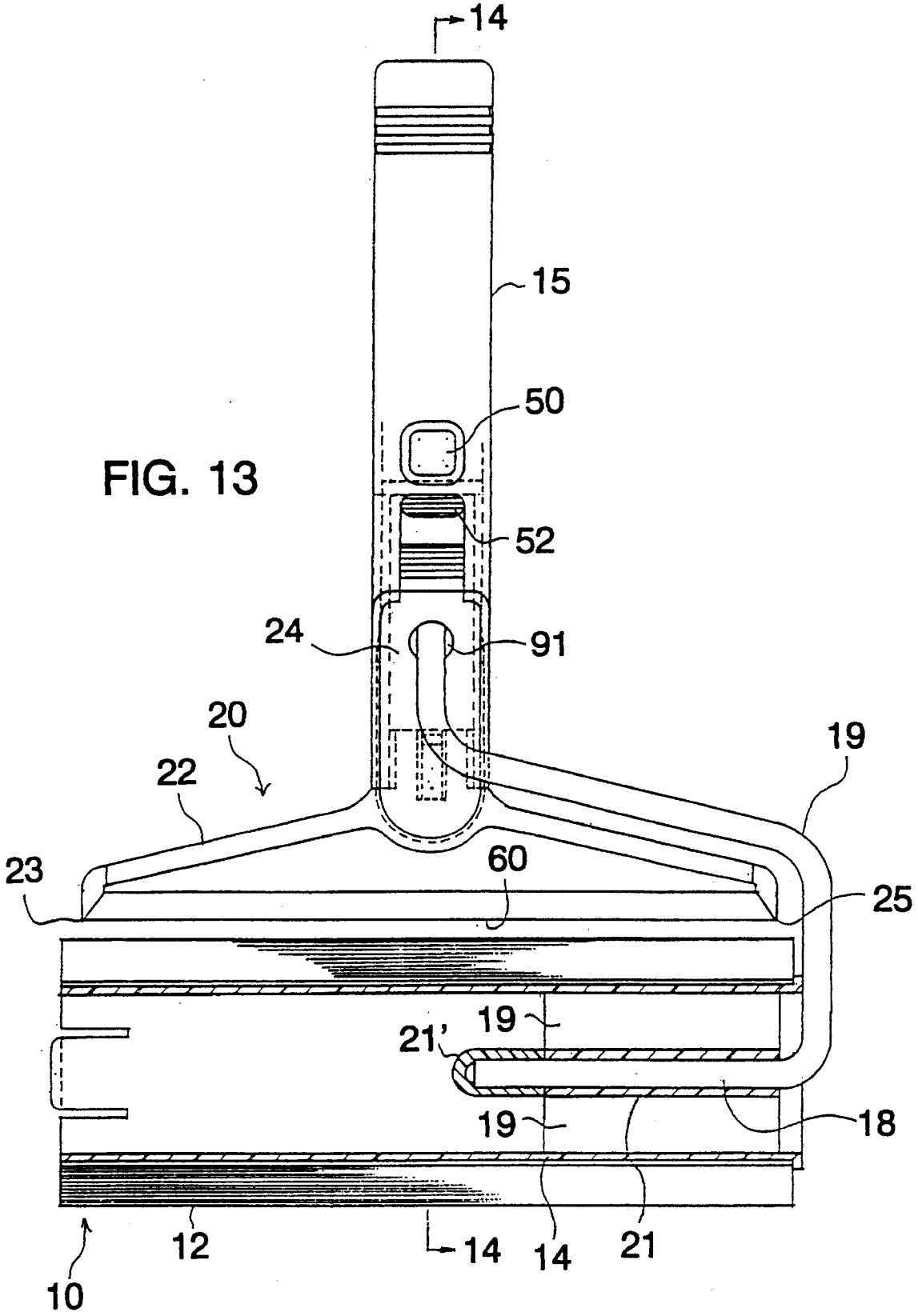
FIG. 13 is a front view showing a second embodiment of the present invention.
Figure 14:
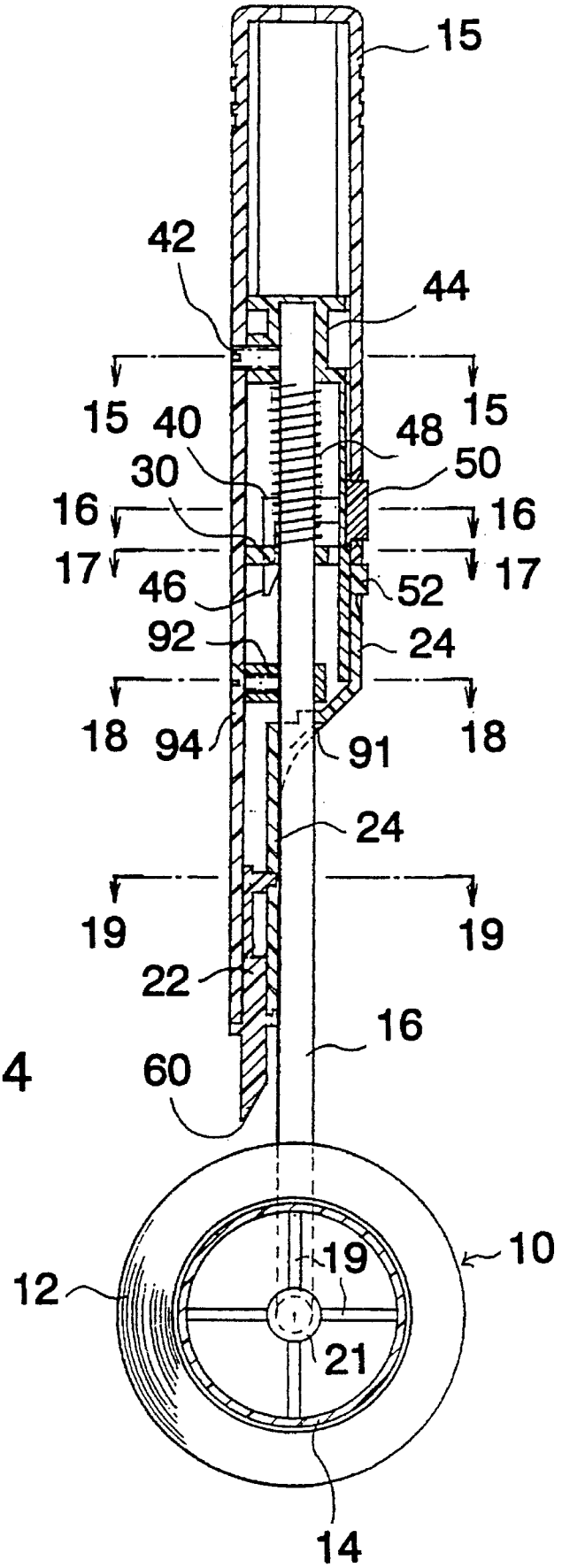
FIG. 14 is a cross section taken along line 14—14 of FIG. 13.
Figure 15:
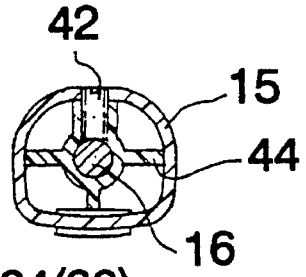
FIG. 15 is an end view taken along line 15—15 of FIG. 14.
Figure 16:
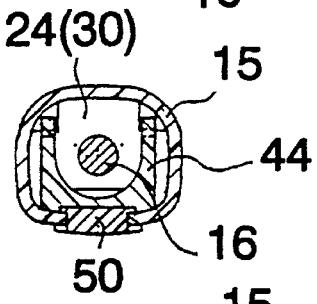
FIG. 16 is an end view taken along line 16—16 of FIG. 14.
Figure 17:
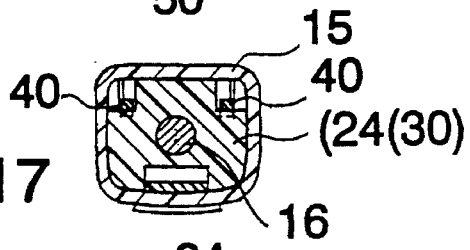
FIG. 17 is an end view taken along line 17—17 of FIG. 14.
Figure 18:
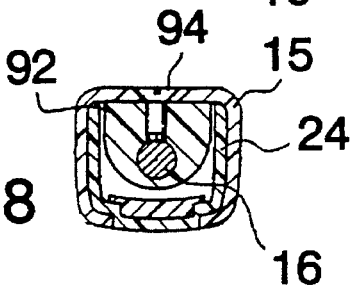
FIG. 18 is an end view taken along line 18—18 of FIG. 14.
Figure 19:
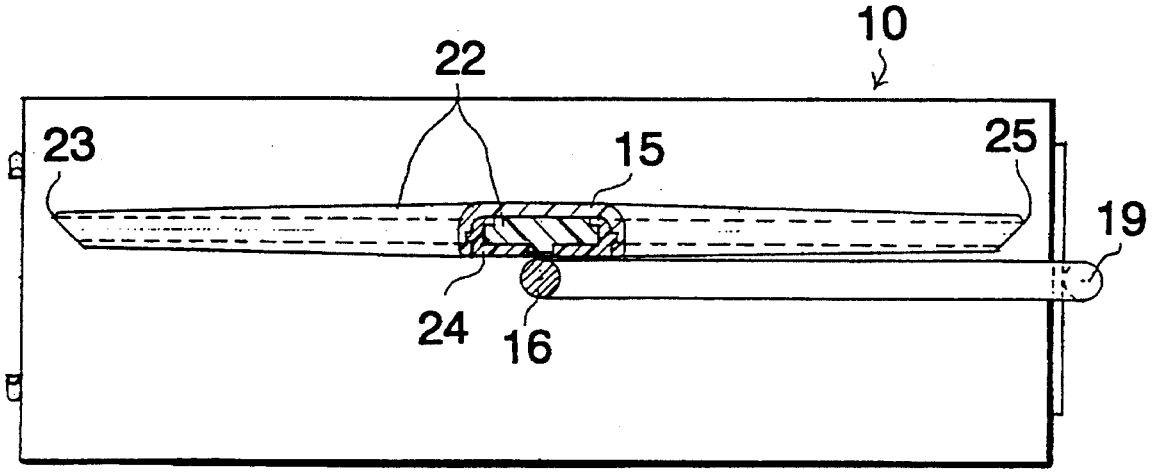
FIG. 19 is an end view taken along line 19—19 of FIG. 14.

A second embodiment of the present invention is shown in FIGS. 13 to 19. In this second embodiment, identical or corresponding portions as in the above first embodiment are denoted by identical reference numerals and their detailed description will be omitted. The second embodiment differs from the first embodiment in that, unlike the first embodiment, the pressing portion 22 of the pressing member 20 is not inclined with respect to the axial line of the adhering roller 10 but is extended substantially in parallel to the axial line. More particularly, as shown in FIGS. 14 and 19, the pressing portion 22 has its lower end edge 60 extended substantially in parallel to the axial line of the adhering roller 10 and has a peeling start end 23 and an opposite side end 25, both ended slightly inward from the widthwise ends of the adhering roller 10. The peeling start end 23 and the opposite side end 25 are formed relatively acutely so as to provide easiness of the operation in tearing the adhesive sheet. As shown in FIGS. 13 and 14, the axis 18 is ended at a point before reaching a half the width of the adhering roller and a large cavity is formed within the tube 14. A supporting projection of an accommodating case (not shown) for the adhering roller may be inserted into this cavity. Numeral 21 denotes an inserting portion for inserting the axis 18 and the inserting portion 21 is fixed within the tube 14 through radially arranged ribs 19. Numeral 21' denotes a cap to prevent the tube 14 from falling off.

Unlike the above described embodiment, the supporting shaft 16 is extended upward from the axis 18 through the connecting portion 19 and is extended within the handle 15 by way of a hole 91 which is formed on a supporting portion 24 of the pressing member 20. While the up and down mechanism of the pressing member 20 in the handle 15 is substantially the same as that of the first embodiment, it is somewhat different in structure. As shown in FIGS. 14 to 18, a base 44 fastened by means of a screw 42 is fixed within the handle 15 in an immobilized manner and a coil spring 48 is placed between the ceiling surface of the base 44 and an upper wall 30 of the supporting portion 24 of the pressing member. The supporting portion 24 is thereby urged downward. A pair of holding pieces 40 are extended downward integrally from substantially the center position in the vertical direction of the base 44. Holding projections 46 are formed at their lower ends, respectively, to engage the lower surface of the above described upper wall 30. Numeral 50 denotes a button type engagement releasing piece. By pressing this to the left as shown in FIG. 14, the engagement between the holding projection of the base 44 and the upper wall 30 of the supporting portion 24 is released so that the pressing member as a whole is lowered toward the adhering roller surface by means of the urging force of the spring 48. Numeral 52 denotes a catch corresponding to the recess in the foregoing embodiment, which consists of a plurality of irregular surfaces. It should be noted that numeral 92 denotes a supporting member for supporting substantially the center portion of the supporting shaft 16, which is also fixed to the handle 15 by a screw 94.

According to the second embodiment, too, when peeling and tearing the adhesive sheet 12, rotation of the adhering roller may be prevented by pressing the pressing member 20 against the adhering roller through a one-touch action. The peeling operation of the adhesive sheet 12 is thereby facilitated. When the adhesive sheet is peeled through the position of the lower end edge 60 of the pressing member 20, it may be torn widthwise along the lower end edge 60. At this time, since the peeling start end 23 is formed relatively acutely and ends slightly inside the outer edge of the adhering roller 10, the side edge on the peeling start end of the adhesive sheet is lifted and, thereby, the acute peeling start end 23 relatively functions to stab the adhesive sheet. Once the adhesive sheet is broken at the peeling start end side, i.e., at the tearing start end side, the adhesive sheet may thereafter be pulled apart easily along the lower end edge 60 of the pressing member. Therefore, the tearing operation is smoothly completed at the opposite side end 25 thereof.

Figure 20:
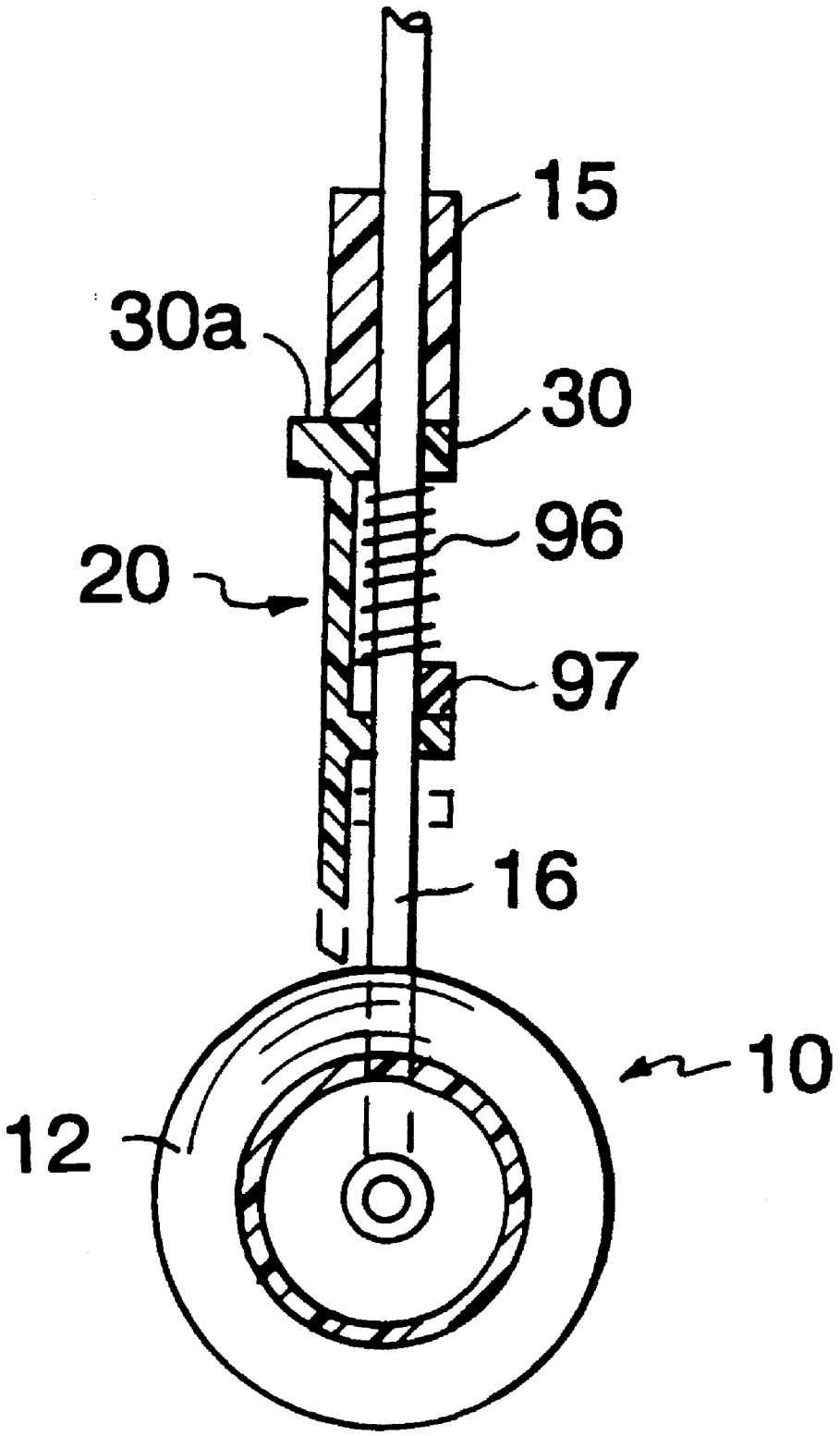
FIG. 20 is a cross section showing a third embodiment of the present invention.

A third embodiment of the present invention is shown in FIG. 20. This embodiment differs from the foregoing embodiments in that the pressing member 20 in its usual state is urged to the direction away from the adhesive roller 10 and, at the time of peeling operation of the adhesive sheet, the pressing member 20 is pressed onto the surface of the adhering roller 10 by fingers of the user. In particular, the pressing member 20 is supported in a manner capable of being moved up and down along the supporting axis 16 and, at the same time, is urged by a coil spring 96 in the direction moving away from the adhering roller 10. Numeral 97 is a member which supports the lower end of the coil spring 96 and is fixed to the supporting axis 16, the upper end of the coil spring 96 abutting against the lower surface of an upper wall 30 of the pressing member 20. The upper wall 30 is formed in a manner projecting outward from the handle 15 so as to form a catching portion 30*a* for a finger.

In this embodiment, when performing peeling operation of the adhesive sheet 12, a finger, for example, the thumb of one hand for holding the handle 15 is hooked on the catch 30*a* to press it down against the urging force of the coil spring 96. Thereby, the pressing member 20 is lowered along the supporting axis and is pressed against the surface of the adhering roller. Thereafter, while maintaining the pressed state of the pressing member 20, the above described peeling and tearing operation may be performed by the other hand. After completing this operation, upon releasing of the pressing force against the pressing member 20, the pressing member 20 is automatically returned to its position separated from the adhering roller by the urging force of the coil spring 96, where cleaning operation may be performed.

In this embodiment, while an example has been shown in which the pressing member 20 is moved up and down along the supporting axis 16, the present invention is not limited to this. For example, the pressing member may be supported in a manner capable of being pivoted with respect to a supporting axis and, when required, the pressing member is urged in the direction away from the adhering roller by an urging means. When the peeling and tearing operation of the adhesive sheet is to be performed, the pressing member may be pressed by means of fingers so that it presses the adhering roller.

As described above, according to the present invention, when tearing the adhesive sheet of the surface layer of the adhering roller, an annoying and unpleasant work such as one in which the surface of the adhering roller is pressed by means of the user's hand is not required. It may be performed by a very simple operation.

What is claimed is:

1. An adhering cleaning tool, comprising:

(a) an adhering roller formed by winding an adhesive sheet in layers, said adhesive sheet being peelable from a portion of the adhesive sheet forming the layer thereunder and easily torn at least along the direction of a width thereof;

(b) supporting means for supporting in a rotatable manner said adhering roller;

(c) a handle connected to said supporting means;

(d) stopper means for stopping rotation of said adhering roller, thereby allowing the user to pinch and peel the adhesive sheet without holding the adhering roller; and e) tearing means for tearing the adhesive sheet along a widthwise direction or the adhesive sheet;

wherein the stopper means comprises a pressing member movable toward and away from the surface or the adhering roller, the pressing member being formed such that, when brought into contact with the surface of the adhering roller, it presses the adhering roller to prevent rotation thereof, and presses the surface of the adhering roller in the direction of the width thereof, whereby said pressing member also functions as said tearing means as the adhesive sheet is torn along the pressing member, and wherein the pressing member has a peeling start widthwise end which extends in the direction opposite to the direction of winding of the adhesive sheet, said peeling start widthwise end indicating a position where the adhesive sheet is to be peeled first.

2. An adhering cleaning tool according to claim 1, wherein said pressing member bas a contacting end edge which is adapted to contact the adhering roller and is formed to have the shape of the outer peripheral surface of the adhering roller when the effective diameter thereof is at its minimum.

3. An adhering cleaning tool according to claim 1, wherein the pressing member comprises a pressing portion having two ends for directly contacting the adhering roller, and a supporting portion, the pressing portion being pivotally supported by the supporting portion, either end of the pressing portion being pivoted toward or away from the adhering roller.

4. An adhering cleaning tool, comprising:

(a) an adhering roller formed by winding an adhesive sheet in layers, said adhesive sheet being peelable from a portion of the adhesive sheet forming the layer thereunder and easily torn at least along the direction of a width thereof;

(b) supporting means for supporting in a rotatable manner said adhering roller;

(c) a handle connected to said supporting means;

(d) stopper means for stopping a rotation of said adhering roller, thereby allowing the user to pinch and peel the adhesive sheet without holding the adhering roller; and (e) tearing means for tearing the adhesive sheet along a widthwise direction of the adhesive sheet;

wherein the stopper means comprises a pressing member movable toward and away from the surface of the adhering roller, the pressing member is formed such that, when brought into contact with the surface of the adhering roller, it presses the adhering roller to prevent rotation thereof, the pressing member presses the surface of the adhering roller in the direction of the width thereof whereby said pressing member also functions as said tearing means as the adhesive sheet is torn along the pressing member; and wherein a support member is connected with the handle and extends substantially perpendicular to the axial line of the adhering roller, the pressing member is supported in a slidable manner on said support member and is urged toward the adhering roller and wherein holding means is provided for holding the pressing member at a position separated from the adhering roller.

5. An adhering cleaning tool, comprising:

(a) an adhering roller formed by winding an adhesive sheet in layers, said adhesive sheet being peelable from a portion of the adhesive sheet forming the layer thereunder and easily torn at least along the direction of a width thereof;

(b) supporting means for supporting in a rotatable manner said adhering roller;

(c) a handle connected to said supporting means;

(d) stopper means for stopping a rotation of said adhering roller, thereby allowing the user to pinch and peel the adhesive sheet without holding the adhering roller; and (e) tearing means for tearing the adhesive sheet along a widthwise direction of the adhesive sheet;

wherein the stopper means comprises a pressing member movable toward and away from the surface of the adhering roller, the pressing member is formed such that, when brought into contact with the surface of the adhering roller, it presses the adhering roller to prevent rotation thereof, the pressing member presses the surface of the adhering roller in the direction of the width thereof whereby said pressing member also functions as said tearing means as the adhesive sheet is torn along the pressing member; and wherein the pressing member is supported in a slidable manner on the handle which extends substantially perpendicular to the axial line of the adhering roller, is urged in the direction moving away from the adhering roller and presses against the adhering roller when pressed by the user.

6. An adhering cleaning tool, comprising:

(a) an adhering roller formed by winding an adhesive sheet in layers, said adhesive sheet being peelable from a portion of the adhesive sheet forming the layer thereunder and easily torn at least along the direction of the width thereof;

(b) supporting means for supporting in a rotatable manner said adhering roller;

(c) a handle connected to said supporting means;

(d) tearing means for tearing the adhesive sheet along the widthwise direction of the adhesive sheet, comprising a pressing member that is movable toward and away from the surface of the adhering roller; and (e) stopper means for preventing rotation of the adhering roller to prevent its rotation, which also allows the user to pinch and peel the adhesive sheet without holding the adhering roller, wherein the pressing member has a peeling start widthwise end which extends in the direction opposite to the direction of winding of the adhesive sheet, said peeling start widthwise end indicating a position where the adhesive sheet is to be peeled first.

7. An adhering cleaning tool according to claim 6, wherein, when said pressing member is brought into contact with the surface of the adhering roller, said pressing member also functions as said stopper means as it presses the adhering roller to prevent its rotation.

8. An adhering cleaning tool according to claim 6, wherein said pressing member has a contacting end edge which is formed to have the shape of the outer peripheral surface of the adhering roller when the effective diameter thereof is at its minimum.

9. An adhering cleaning tool according to claim 6, wherein the pressing member comprises a pressing portion for directly contacting the adhering roller, and a supporting portion, the pressing portion being pivotally supported to the supporting portion with respect to the direction along which it is moved toward and away from the adhering roller.

10. An adhering cleaning tool, comprising:

(a) an adhering roller formed by winding an adhesive sheet in layers, said adhesive sheet being peelable from a portion of the adhesive sheet forming the layer thereunder and easily torn at least along the direction of the width thereof;

(b) supporting means for supporting in a rotatable manner said adhering roller;

(c) a handle connected to said supporting means; and (d) tearing means for tearing the adhesive sheet along the widthwise direction of the adhesive sheet, said tearing means comprising a pressing member that is movable toward and away from the surface of the adhering roller;

wherein a supporting member is connected with the handle and extends substantially perpendicular to the axial line of the adhering roller, the pressing member is supported in a slidable manner on said supporting member and is urged toward the adhering roller and wherein holding means is provided for holding the pressing member at a position separated from the adhering roller.

11. An adhering cleaning tool, comprising:

(a) an adhering roller formed by winding an adhesive sheet in layers, said adhesive sheet being peelable from a portion of the adhesive sheet forming the layer thereunder and easily torn at least along the direction of the width thereof;

(b) supporting means for supporting in a rotatable manner said adhering roller;

(c) a handle connected to said supporting means; and (d) tearing means for tearing the adhesive sheet along the widthwise direction of the adhesive sheet, said tearing means comprising a pressing member that is movable toward and away from the surface of the adhering roller;

wherein the pressing member is supported in a slidable manner on a supporting member connected with the handle which extends substantially perpendicular to the axial line of the adhering roller, is urged in the direction moving away from the adhering roller and presses against the adhering roller when pressed by the user.

* * * * *